US010920301B2

(12) United States Patent
Yamamoto et al.

(10) Patent No.: US 10,920,301 B2
(45) Date of Patent: Feb. 16, 2021

(54) ALUMINUM ALLOY CASTING HAVING SUPERIOR HIGH-TEMPERATURE STRENGTH AND THERMAL CONDUCTIVITY, METHOD FOR MANUFACTURING SAME, AND ALUMINUM ALLOY CASTING PISTON FOR INTERNAL COMBUSTION ENGINE

(71) Applicants: Nippon Light Metal Company, Ltd., Tokyo (JP); Honda Motor Co., Ltd., Tokyo (JP)

(72) Inventors: Izumi Yamamoto, Shizuoka (JP); Kazuhiro Oda, Shizuoka (JP); Hisayasu Kojima, Saitama (JP); Naoko Sato, Saitama (JP); Ryo Wakabayashi, Saitama (JP); Akito Tanihata, Saitama (JP)

(73) Assignees: Nippon Light Metal Company, Ltd., Tokyo (JP); Honda Motor Co., Ltd., Tokyo (JP)

( * ) Notice: Subject to any disclaimer, the term of this patent is extended or adjusted under 35 U.S.C. 154(b) by 221 days.

(21) Appl. No.: 15/565,940

(22) PCT Filed: Apr. 14, 2016

(86) PCT No.: PCT/JP2016/062027
§ 371 (c)(1),
(2) Date: Oct. 12, 2017

(87) PCT Pub. No.: WO2016/167322
PCT Pub. Date: Oct. 20, 2016

(65) Prior Publication Data

US 2018/0094338 A1 Apr. 5, 2018

(30) Foreign Application Priority Data

Apr. 15, 2015 (JP) ..... 2015-083605

(51) Int. Cl.

| | |
|---|---|
| ***C22C 21/02*** | (2006.01) |
| ***B22D 27/04*** | (2006.01) |
| ***B22D 27/20*** | (2006.01) |
| ***C22F 1/043*** | (2006.01) |
| ***B22D 21/00*** | (2006.01) |
| ***F02F 3/00*** | (2006.01) |
| ***C22F 1/00*** | (2006.01) |
| ***B22D 17/00*** | (2006.01) |
| ***C22C 21/04*** | (2006.01) |

(52) U.S. Cl.
CPC ..... *C22C 21/02* (2013.01); *B22D 17/00* (2013.01); *B22D 21/007* (2013.01); *B22D 27/04* (2013.01); *B22D 27/20* (2013.01); *C22C 21/04* (2013.01); *C22F 1/043* (2013.01); *F02F 3/0084* (2013.01); *C22F 1/00* (2013.01)

(58) Field of Classification Search
CPC ..... C22F 1/043; C22C 21/02
See application file for complete search history.

(56) References Cited

U.S. PATENT DOCUMENTS

| | | | | |
|---|---|---|---|---|
| 5,762,728 | A * | 6/1998 | Kuramasu | B22D 21/007 148/439 |
| 9,222,151 | B2 * | 12/2015 | Xing | B22D 21/007 |
| 2013/0115129 | A1 * | 5/2013 | Xing | B22D 21/007 420/535 |

FOREIGN PATENT DOCUMENTS

| | | | |
|---|---|---|---|
| CN | 103003458 | A | 3/2013 |
| JP | 64-73044 | A | 3/1989 |
| JP | 8-134578 | A | 5/1996 |
| JP | 5482899 | B2 | 2/2014 |
| WO | 2012/008470 | A1 | 1/2012 |

OTHER PUBLICATIONS

English Machine Translation of JP 64-073044 A published Mar. 17, 1989.
English Machine Translation of JP 08-134578 A published May 28, 1996.
Office Action for the corresponding Chinese application 2016-80021296.2 dated Jan. 21, 2019 (English ranslation—pp. 1-7).
International Search Report dated Jul. 19, 2016 issued in corresponding PCT/JP2016/062027 application (1 page).
English Abstract of JP 64-73044 A published Mar. 17, 1989.
English Abstract of JP 08-134578 A published May 28, 1996.

* cited by examiner

*Primary Examiner* — Colleen P Dunn
*Assistant Examiner* — Sean P. O'Keefe
(74) *Attorney, Agent, or Firm* — Millen White Zelano and Branigan, PC; John Sopp

(57) ABSTRACT

An aluminum alloy casting excellent in high temperature strength and thermal conductivity, a method of producing the same, and an aluminum alloy piston for internal combustion engine using this casting. An aluminum alloy casting having a chemical composition comprising
Si: 12.0 to 13.5 mass %
Cu: 4.5 to 5.5 mass %
Mg: 0.6 to 1.0 mass %
Ni: 0.7 to 1.3 mass %
Fe: 1.15 to 1.25 mass %
Ti: 0.10 to 0.2 mass %
P: 0.004 to 0.02 mass % and
a balance of Al and unavoidable impurities, wherein in an observed field of view of 0.2 $mm^2$, the major axis length of the Al—Fe—Si based crystallites is 100 μm or less by average length of 10 crystallites from the largest down. The method for producing the casting comprising casting a melt of aluminum alloy having the above chemical composition at cooling rate of 100° C./sec or more, then performing aging treatment.

5 Claims, No Drawings

ALUMINUM ALLOY CASTING HAVING SUPERIOR HIGH-TEMPERATURE STRENGTH AND THERMAL CONDUCTIVITY, METHOD FOR MANUFACTURING SAME, AND ALUMINUM ALLOY CASTING PISTON FOR INTERNAL COMBUSTION ENGINE

TECHNICAL FIELD

The present invention relates to an aluminum alloy casting excellent in high temperature strength and thermal conductivity and a method for producing the same. The aluminum alloy casting of the present invention is particularly suitable for a piston for internal combustion engine use.

BACKGROUND ART

An aluminum alloy generally falls in strength the higher the temperature. For this reason, aluminum alloys used for parts used at high temperatures such as pistons for internal combustion engines are kept from falling in strength at a high temperature by increasing added elements such as Si, Cu, Ni, Mg, and Fe and by increasing the amount of crystallites such as secondary phase particles which are difficult to soften even if raising the temperature.

Among the added elements, Fe is an element effective for maintaining the high temperature strength, but if the amount of addition increases, coarse needle-like crystallites are likely to be formed. The coarse needle-shaped crystallites become the starting points of fracture and conversely cause a drop in elongation and strength. Therefore, the practice has been to add Mn to cause Fe-based crystallites to clump together.

However, when the amount of addition of Mn is large, the thermal conductivity of the aluminum alloy falls, it becomes difficult to lower the temperature by heat dissipation, and the piston is exposed to a high temperature for a long time and the load is increased.

Therefore, the present applicant proposed to irradiate the molten metal by ultrasonic vibration during casting to thereby shorten the needle-like Fe-based crystallites to prevent coarsening without adding Mn (PLT 1).

CITED DOCUMENT LIST

Patent Literature

PLT 1: Japanese Patent No. 5482899

SUMMARY OF INVENTION

Technical Problem

However, the method of irradiating ultrasonic waves at the time of casting as in the above proposal has problems such as equipment costs, productivity, and the like and has been higher in production costs.

Therefore, in the present invention, the object is to provide an aluminum alloy casting with short needle-like Fe-based crystallites and excellent high temperature strength and heat resistance without adding Mn (a factor lowering heat resistance) or irradiation with ultrasonic waves (a factor increasing production cost), a method for producing the same, and an aluminum alloy piston for internal combustion engine use using this casting.

Solution to Problem

The present inventors engaged in intensive research and as a result discovered that by suppressing the amount of addition of Fe in the alloy composition and rapidly cooling at the time of casting, it is possible to shorten the length of Fe-based crystallites even without lowering the Mn content or ultrasonic irradiation. As a result of further research, they newly discovered that if cooling by a high speed of 100° C./sec or more at the time of casting, it is possible to shorten the average length of the Fe-based crystallites to an extent where the mechanical properties of the piston are not impaired (100 μm or less).

Further, desirably, if increasing the Cu/Ni ratio of the contents of Cu and Ni in the aluminum alloy melt to be cast, the crystallization temperature of the Al—Ni—Cu based compound falls, so the time from the start of crystallization to the end of solidification need only be short and the casting is completed with almost no growth of the crystallized Al—Ni—Cu based compound (of course, under the influence of the casting speed). As a result, they also discovered that the Al—Ni—Cu based compound becomes finer and castability and mechanical properties are improved. Furthermore, they learned that chipping of the workpiece during finish cutting can be suppressed by making the crystallites finer.

Therefore, in order to solve the above-mentioned problems, the aluminum alloy casting of the present invention is characterized by having a chemical composition comprising:

Si: 12.0 to 13.5 mass %
Cu: 4.5 to 5.5 mass %
Mg: 0.6 to 1.0 mass %
Ni: 0.7 to 1.3 mass %
Fe: 1.15 to 1.25 mass %
Ti: 0.10 to 0.2 mass %
P: 0.004 to 0.02 mass % and a balance of Al and unavoidable impurities, wherein, in an observed field of view of 0.2 $mm^2$, the major axis length of the Al—Fe—Si based crystallites is 100 μm or less by average length of 10 crystallites from the largest down.

In a preferred embodiment of the present invention, the Cu/Ni ratio of the contents of Cu and Ni is 3.4 or more. More desirably, Cu/Ni is 4 or more.

The aluminum alloy casting of the present invention is particularly suitable for an aluminum alloy piston for internal combustion engine use.

The method for producing an aluminum alloy casting according to the present invention is characterized by casting an aluminum alloy melt having the above chemical composition at a cooling rate of 100° C./sec or more, then treating it to age it.

Advantageous Effect of Invention

The aluminum alloy casting of the present invention enables achievement of the excellent high temperature strength and thermal conductivity demanded from an aluminum alloy piston for internal combustion engine use by making the major axis length of the Al—Fe—Si based crystallites in a 0.2 $mm^2$ observed field 100 μm or less in average length of 10 crystallites from the largest down.

The method of producing an aluminum alloy casting of the present invention casts an aluminum alloy melt having the above chemical composition by a cooling rate of 100° C./sec or more, then treats it to age it to enable the major axis length of the Al—Fe—Si based crystallites in a 0.2 $mm^2$ observed field be made 100 μm or less in average length of 10 crystallites from the largest down and enable achievement of the excellent high temperature strength and thermal conductivity demanded from an aluminum alloy piston for internal combustion engine use.

DESCRIPTION OF EMBODIMENTS

Below, the reasons for limiting the constituent requirements of the present invention will be described.

Chemical Composition

Si: 12.0 to 13.5 mass %

Si crystallizes as primary crystal Si and has the action of improving the high temperature strength of the piston by dispersion strengthening. This effect becomes remarkable with an Si content of 12.0 mass % or more. On the other hand, if the Si content exceeds 13.5 mass %, the thermal conductivity is reduced. In addition, the amount of crystallites also increases, and the elongation and workability fall. Furthermore, Si precipitates as Mg—Si based precipitates by aging treatment and not only improves strength by dispersion strengthening but also has the effect of simultaneously improving thermal conductivity.

Cu: 4.5 to 5.5 mass %

Cu has the action of improving the high temperature strength. When adding it simultaneously with Ni, it crystallizes as Al—Ni—Cu based crystallites and improves high temperature strength by dispersion strengthening. This action becomes remarkable by the addition of 4.5 mass % or more. On the other hand, if the amount of addition exceeds 5.5 mass %, the thermal conductivity ends up falling. Improvement of the specific strength can no longer be obtained if the alloy density becomes higher.

Ni: 0.7 to 1.3 mass %

Ni has the action of improving the high temperature strength. When added at the same time as Cu, it crystallizes as Al—Ni—Cu based crystallites and improves high temperature strength by dispersion strengthening. This action becomes remarkable by the addition of 0.7 mass % or more. On the other hand, if the amount of addition exceeds 1.3 mass %, the thermal conductivity ends up falling. In addition, the alloy density becomes higher and improvement in specific strength can no longer be obtained. Also, among the elements added to the piston of the present invention, Ni is a particularly expensive element, so if the amount of addition of Ni increases, the production costs rise.

Preferably, Cu/Ni Ratio: 3.4 or More

In a preferred embodiment of the present invention, the ratio Cu/Ni of the contents of Cu and Ni is made 3.4 or more. If the Cu/Ni ratio increases, the crystallization temperature of the Al—Ni—Cu based compound decreases, so the time from the start of crystallization to completion of solidification can be shorter. As a result, the casting is completed (under the influence of the casting speed) with almost no growth of the crystallized Al—Ni—Cu based compound. Therefore, the Al—Ni—Cu based compound becomes finer and the mechanical properties are improved. Simultaneously, the castability is also improved. This action becomes remarkable when the Cu/Ni ratio is 3.4 or more, more preferably 4 or more.

Mg: 0.6 to 1.0 mass %

Mg has the action of improving high temperature strength. This effect becomes remarkable with an Mg content of 0.6 mass % or more. In addition, when performing aging treatment, it precipitates as an Mg—Si based precipitate whereby the strength and thermal conductivity are improved. On the other hand, if the Mg content exceeds 1.0 mass %, the thermal conductivity decreases. In addition, the amount of crystallites also increases, and the elongation and workability deteriorate.

Fe: 1.15 to 1.25 mass %

When Fe is added simultaneously with Si, it forms Al—Fe—Si based crystallites, contributes to dispersion strengthening, and improves high temperature strength. This effect becomes remarkable with an amount of addition of Fe at 1.15 mass % or more. On the other hand, if the amount of addition exceeds 1.25 mass %, even if the cooling rate at the time of casting becomes higher, it becomes difficult to suppress the coarsening of crystallites.

Ti: 0.10 to 0.2 mass %

Ti becomes the nuclei of crystallization of the Al—Fe—Si based crystallites and has the action of making the Al—Fe—Si based crystallites finely and uniformly disperse to improve the high temperature strength. This action becomes remarkable by the addition of 0.10 mass % or more. Conversely, if adding over 0.2 mass %, the thermal conductivity decreases.

P: 0.004 to 0.02 mass %

P forms an AlP compound which acts as nuclei of crystallization when primary crystal Si crystallizes and acts to make the primary crystal Si finely and uniformly disperse and to improve the high temperature strength. This action becomes remarkable with a P content of 0.004 mass % or more. If the P content exceeds 0.02 mass %, the fluidity of the melt during casting becomes poor and the castability ends up falling.

Unavoidable Impurities

Impurities generally unavoidably mixed in besides the above elements are allowed. However, Mn has a large influence on thermal conductivity, so it is desirable to limit the Mn content to 0.2% or less.

Major Axis Length of Crystallites: 100 μm or Less

When the major axis length of the crystallites becomes larger than 100 μm, when a large force is applied to the piston, they are liable to become starting points of fracture and decrease the tensile strength of the piston.

Cooling Rate During Casting: 100° C./s or More

When making the cooling rate at the time of casting 100° C./sec or more, the major axis length of the crystallites of the alloy of the present invention composition can be suppressed to 100 μm or less and the tensile strength can be increased. Note that as the method for casting at a cooling rate of 100° C./sec or more, there is the die cast method.

Aging Treatment

By aging treatment, Mg—Si based compounds and Al—Cu based compounds precipitate and the high temperature strength increases. Also, due to this precipitation, the dissolved amounts of Mg, Si, and Cu in the Al matrix phase decrease and the thermal conductivity improves. Furthermore, at the time of quenching during casting, distortion generated in the piston is eliminated, so the thermal conductivity is also improved from that viewpoint. The desirable aging treatment conditions are as follows:

Holding temperature: 200 to 300° C. (most desirably 250° C.)

Holding time: 10 to 60 min (most desirably 20 min)

EXAMPLES

Below, the present invention will be explained in more detail by examples.

Example 1

Preparation of Samples

In order to confirm the influence of the chemical composition, samples were prepared with chemical compositions within the prescribed range of the present invention and out of the prescribed range and with manufacturing conditions fixed within the prescribed range of the present invention.

TABLE 1

(Unit: mass %)

| | Inventive composition | | | Comparative composition | | |
|---|---|---|---|---|---|---|
| Composition | Inventive Composition 1 | Inventive Composition 2 | Inventive Composition 3 | Comparative Composition 1 | Comparative Composition 2 | Comparative Composition 3 |
| Si | 12.9 | 12.2 | 12.5 | 12.5 | 13.0 | 12.5 |
| Fe | 1.22 | 1.17 | 1.20 | 1.4 | 1.2 | 1.0 |
| Cu | 5.0 | 4.6 | 4.8 | 4.8 | 4.0 | 4.6 |
| Ni | 1.0 | 1.2 | 0.8 | 0.8 | 2.0 | 1.0 |
| Mg | 0.8 | 0.9 | 0.7 | 0.8 | 1.0 | 0.7 |
| Ti | 0.15 | 0.12 | 0.13 | 0.12 | 0.2 | 0.12 |
| P | 0.010 | 0.015 | 0.012 | 0.012 | 0.010 | 0.010 |
| Cu/Ni | 5.00 | 3.83 | 6.00 | 3.84 | 2.00 | 4.60 |

| | Comparative composition | | | | | |
|---|---|---|---|---|---|---|
| Composition | Comparative Composition 4 | Comparative Composition 5 | Comparative Composition 6 | Comparative Composition 7 | Comparative Composition 8 | Comparative Composition 9 |
| Si | 12.4 | 12.9 | 12.2 | 12.5 | 11.0 | 14.2 |
| Fe | 1.2 | 1.22 | 1.17 | 1.20 | 1.16 | 1.20 |
| Cu | 6.0 | 5.0 | 4.6 | 4.8 | 4.7 | 5.3 |
| Ni | 1.0 | 0.5 | 0.8 | 1.2 | 0.9 | 1.2 |
| Mg | 0.9 | 0.8 | 0.4 | 1.2 | 0.7 | 0.9 |
| Ti | 0.12 | 0.15 | 0.12 | 0.13 | 0.12 | 0.12 |
| P | 0.010 | 0.010 | 0.015 | 0.012 | 0.010 | 0.010 |
| Cu/Ni | 6.00 | 10.00 | 5.75 | 4.00 | 5.22 | 4.42 |

(Note)
Underlines indicate outside prescribed range of present invention.

Table 1 shows the chemical composition of each sample. In the Inventive Compositions 1 to 3, the contents of the components and the Cu/Ni ratios are all within the prescribed ranges of the present invention, while in Comparative Compositions 1 to 9, at least single ones of the component contents and Cu/Ni ratios are outside the ranges specified in the present invention. An aluminum alloy melt having each of the chemical compositions shown in Table 1 was prepared and cast into a cylinder of 100 mmϕ×200 mmH at a cooling rate of 110° C./sec within the prescribed ranges of the present invention by the vacuum die cast method. The obtained die-cast material was aged at a holding temperature of 250° C. and a holding time of 20 min.

Measurement and Observation

Each sample treated for aging was measured and observed as follows. By observation by an optical microscope, in an observed field of 0.2 $mm^2$, the average length of 10 crystallites was measured from the largest major axis length of the Al—Fe—Si based crystallites down and used as the size of the crystallites. The mechanical properties by tensile test at 350° C. and room temperature and the thermal conductivity at room temperature were measured. The surface of the casting was machine cut, the surface was visually observed, and the cuttability was judged by the surface conditions. The results of measurement and observation are shown in Table 2.

TABLE 2

| | | Inv. Ex. 1 | Inv. Ex. 2 | Inv. Ex. 3 | Comp. Ex. 1 | Comp. Ex. 2 | Comp. Ex. 3 |
|---|---|---|---|---|---|---|---|
| 350° C. | Tensile strength (MPa) | 90 | 92 | 88 | 90 | 92 | 80 |
| | Elongation at break (%) | 9.9 | 9.5 | 10 | 8 | 9.5 | 12 |
| Room temperature | Tensile strength (MPa) | 278 | 270 | 280 | 250 | 70 | 260 |
| | Elongation at break (%) | 0.4 | 0.3 | 0.5 | <0.1 | 0.3 | 0.3 |
| Thermal conductivity (W/m · k) | | 120 | 122 | 121 | 115 | 117 | 121 |

TABLE 2-continued

| | | | | | | | |
|---|---|---|---|---|---|---|---|
| Size of crystallites (μm) | | 91 | 96 | 87 | 150 | 130 | 93 |
| Surface conditions after cutting | | Good | Good | Good | Poor | Poor | Good |
| | | Comp. Ex. 4 | Comp. Ex. 5 | Comp. Ex. 6 | Comp. Ex. 7 | Comp. Ex. 8 | Comp. Ex. 9 |
| 350° C. | Tensile strength (MPa) | 90 | 75 | 78 | 93 | 78 | 93 |
| | Elongation at break (%) | 9 | 14 | 13 | 9.3 | 12 | 9 |
| Room temperature | Tensile strength (MPa) | 280 | 268 | 265 | 260 | 279 | 250 |
| | Elongation at break (%) | <0.1 | 0.5 | 0.4 | <0.1 | 0.5 | <0.1 |
| Thermal conductivity (W/m · k) | | 114 | 122 | 120 | 121 | 120 | 122 |
| Size of crystallites (μm) | | 121 | 85 | 90 | 116 | 90 | 113 |
| Surface conditions after cutting | | Poor | Good | Good | Poor | Good | Poor |

(Note)

Invention Examples 1 to 3: Inventive Compositions 1 to 3, cooling rate 110° C./sec (=inside prescribed range).

Comparative Examples 1 to 9: Comparative Compositions 1 to 9, cooling rate 110° C./sec (=inside prescribed range).

Underlines: Shows outside prescribed range of present invention for "size of crystallites", while shows clearly inferior compared with Inventive Examples 1 to 3 for other items.

Evaluation of Results

Inventive Examples 1 to 3 are Inventive Compositions 1 to 3 with compositions within the prescribed ranges of the present invention and with cooling rates at the time of casting of 110° C./sec satisfying the prescribed range of 100° C./sec or more in the present invention. Due to this, good results were obtained for all of the crystallite size, mechanical properties, thermal conductivity, and machinability. In particular, the crystallite size was 87 μm to 96 μm which satisfied the prescribed range of 100 μm or less according to the present invention.

The mechanical properties were as follows.

Stable results were obtained.

350° C.: Tensile strength 88 to 92 MPa

Elongation at break 9.5 to 10%

Room temperature: Tensile strength 270 to 280 MPa

Elongation at break 0.3 to 0.5%

The thermal conductivity was 120 to 122 W/(m·k). Stable results were obtained. The surface properties were good, the cuttability was stable, and good results were obtained.

In Inventive Examples 1 to 3, it is understood that the higher the Cu/Ni ratio, the finer the crystallites and the better the elongation at break, tensile strength, and surface roughness at room temperature.

In Comparative Examples 1 to 9, the cooling rate satisfied the prescribed range of the present invention, but Comparative Compositions 1 to 9 whose compositions were outside the prescribed ranges of the present invention were inferior to the inventive examples as follows.

Comparative Example 1

The Fe content was excessive with respect to the specified composition of the present invention, so the average length of the Al—Fe—Si based crystallites was 150 μm or over the upper limit 100 μm of the prescribed range of the present invention. Compared with the inventive examples, the elongation at break at room temperature was a low one of less than 0.1%, so the tensile strength at room temperature was a poor 250 MPa. The thermal conductivity was also a low 115 W/(m·k) and the surface conditions after machining were poor (Poor).

Comparative Example 2

The Cu content was insufficient, the Ni content was excessive and the Cu/Ni ratio was small, so the average length of the Al—Fe—Si based crystallites was 130 μm or over the prescribed upper limit, the thermal conductivity was a low 117 W/(m·k), and the surface conditions after machining were poor (Poor).

Comparative Example 3

The Fe content was insufficient, so the high temperature tensile strength at 350° C. was an inferior 80 MPa.

Comparative Example 4

The Cu content was excessive, so the average crystallite length was 121 μm or exceeding the prescribed upper limit. Therefore, the elongation at break at room temperature was a low one of less than 0.1% and the surface conditions after cutting were also poor (Poor). The thermal conductivity was also an inferior 114 W/(m·k).

Comparative Example 5

The Ni content was insufficient, so the high temperature tensile strength at 350° C. was an inferior 75 MPa.

Comparative Example 6

The Mg content was insufficient, so the high temperature tensile strength at 350° C. was an inferior 78 MPa.

Comparative Example 7

The Mg content became excessive, so the average crystallite length was 116 μm or exceeding the prescribed upper limit, therefore the elongation at break at room temperature was a low less than 0.1%, and the surface conditions after cutting were poor (Poor).

Comparative Example 8

The Si content was insufficient, so the high temperature tensile strength at 350° C. was an inferior 78 MPa.

Comparative Example 9

The Si content was excessive, and the average crystallite length was 113 μm or exceeding the prescribed upper limit, so the elongation at break room temperature was a low less than 0.1% and the surface conditions after cutting were poor (Poor).

Example 2

Preparation of Sample

In the same way as in Example 1, an aluminum alloy melt having the chemical composition shown in Table 1 was prepared. Unlike Example 1, the gravity die casting method was used to produce a 100 mmϕ×200 mmH column at a cooling rate of 25° C./sec outside the prescribed range of the present invention. The obtained heavy casted material was aged at a holding temperature of 250° C. and a holding time of 20 minutes.

Measurement and Observation

The sample after the aging treatment was measured and observed in the same manner as in Example 1. The results are shown in Table 3.

TABLE 3

| | | Comp. Ex. 11 | Comp. Ex. 12 | Comp. Ex. 13 | Comp. Ex. 21 | Comp. Ex. 22 | Comp. Ex. 23 |
|---|---|---|---|---|---|---|---|
| 350° C. | Tensile strength (MPa) | 87 | 88 | 85 | 86 | 89 | 78 |
| | Elongation at break (%) | 9.3 | 9.4 | 9.7 | 8 | 9.4 | 11 |
| Room temperature | Tensile strength (MPa) | 258 | 250 | 260 | 230 | 250 | 240 |
| | Elongation at break (%) | <0.1 | <0.1 | <0.1 | <0.1 | <0.1 | <0.1 |
| Thermal conductivity (W/m · k) | | 120 | 122 | 121 | 115 | 117 | 121 |
| Size of crystallites (μm) | | 121 | 126 | 117 | 170 | 150 | 113 |
| Surface conditions after cutting | | Poor | Poor | Poor | Poor | Poor | Poor |

| | | Comp. Ex. 24 | Comp. Ex. 25 | Comp. Ex. 26 | Comp. Ex. 27 | Comp. Ex. 28 | Comp. Ex. 29 |
|---|---|---|---|---|---|---|---|
| 350° C. | Tensile strength (MPa) | 86 | 72 | 75 | 90 | 76 | 90 |
| | Elongation at break (%) | 8.9 | 13 | 12.5 | 9.1 | 11 | 8.7 |
| Room temperature | Tensile strength (MPa) | 260 | 248 | 245 | 240 | 259 | 230 |
| | Elongation at break (%) | <0.1 | <0.1 | <0.1 | <0.1 | <0.1 | <0.1 |
| Thermal conductivity (W/m · k) | | 114 | 122 | 120 | 121 | 120 | 122 |
| Size of crystallites (μm) | | 111 | 125 | 110 | 136 | 110 | 133 |
| Surface conditions after cutting | | Poor | Poor | Poor | Poor | Poor | Poor |

(Note)

Comparative Examples 11 to 13: Inventive Compositions 1 to 3, cooling rate 25° C./sec (=outside prescribed range).

Comparative Examples 21 to 29: Comparative Compositions 1 to 9, cooling rate 25° C./sec (=outside prescribed range).

Underlines: Shows outside prescribed range of present invention for "size of crystallites", while shows clearly inferior compared with Inventive Examples 1 to 3 (Table 2) for other items.

Evaluation of Results

In Table 3, in Comparative Examples 11, 12, and 13, the compositions are the Inventive Compositions 1, 2, and 3, but the cooling rate during casting was 25° C./sec which is slower than the prescribed range of 100° C./sec in the present invention. In Comparative Examples 21 to 29, the compositions were Comparative Compositions 1 to 9 the same as in Example 1, and the cooling rate during casting was 25° C./sec which was slower than the prescribed range of 100° C./sec in the present invention. From Table 2 and Table 3, it will be understood that the casting cast by gravity casting with the slower cooling rate during casting has a longer major axis length of the Al—Fe—Si type crystallites even if the same composition, in particular, has a remarkable drop in mechanical properties, in particular the elongation at a room temperature tensile test. As described above, in order to attain the effect of the present invention, it is necessary to control the chemical composition, then control the major axis length of the crystallites to become short. For that reason, it is necessary to control the cooling rate during casting at a high speed.

INDUSTRIAL APPLICABILITY

According to the aluminum alloy casting of the present invention, the high temperature strength and thermal conductivity demanded from an aluminum alloy piston for internal combustion engine use can be achieved by controlling the chemical composition and the major axis length of the crystallites. According to the method for producing an aluminum alloy casting of the present invention, an aluminum alloy casting achieving the high temperature strength and thermal conductivity demanded from an aluminum alloy piston for internal combustion engine use by controlling the chemical composition and the cooling rate during casting can be produced.

The invention claimed is:

1. An aluminum alloy casting, characterized by having a chemical composition comprising Si: 12.0 to 13.5 mass %

Cu: 4.5 to 5.5 mass %

Mg: 0.6 to 1.0 mass %

Ni: 0.7 to 1.3 mass %

Fe: 1.15 to 1.25 mass %

Ti: 0.10 to 0.2 mass %

P: 0.004 to 0.02 mass % and a balance of Al and unavoidable impurities, provided that the ratio Cu/Ni of the contents of Cu and Ni is 3.83 or more, wherein the alloy contains Al—Fe—Si based crystallites and, in an observed field of view of 0.2 $mm^2$, the major axis length of the Al—Fe—Si based crystallites is 96 μm or less in terms of the average length of 10 crystallites from the largest major axis length down.

2. The aluminum alloy casting according to claim 1, wherein the alloy has a tensile strength at 350° C. of 88 MPa or more.

3. An aluminum alloy piston for internal combustion engine use, characterized by consisting of an aluminum alloy casting according to claim 1.

4. A method for producing an aluminum alloy casting, characterized by casting a melt of an aluminum alloy having a chemical composition according to claim 1 at a cooling rate of 100° C./sec or more, followed by aging treatment, thereby obtaining an aluminum alloy casting having a major axis length of the Al—Fe—Si based crystallites of 96 μm or less in terms of the average length of 10 crystallites from the largest major axis length down in an observed field of view of 0.2 $mm^2$.

5. The method for producing an aluminum alloy casting according to claim 4, comprising performing said casting by a die cast method.

* * * * *